US005580286A

United States Patent [19]

Krämer et al.

[11] Patent Number: 5,580,286

[45] Date of Patent: Dec. 3, 1996

[54] ELECTRICAL CONNECTOR/ASSEMBLY WITH SCREW CLAMP TERMINALS

[75] Inventors: Rudolf Krämer, Lautertal; Werner Tille, Stockstadt, both of Germany

[73] Assignee: The Whitaker Corporation, Wilmington, Del.

[21] Appl. No.: 412,785

[22] Filed: Mar. 29, 1995

[30] Foreign Application Priority Data

May 5, 1994 [GB] United Kingdom ..... 9408878

[51] Int. Cl.[6] ..... H01R 4/30; H01R 4/34

[52] U.S. Cl. ..... 439/813; 439/801

[58] Field of Search ..... 439/813, 801, 439/814

[56] References Cited

U.S. PATENT DOCUMENTS

| | | | |
|---|---|---|---|
| 4,519,668 | 5/1985 | Fujita et al. | 339/241 |
| 4,529,261 | 7/1985 | Stenz et al. | 339/272 R |
| 4,542,953 | 9/1985 | Iwamoto et al. | 339/198 GA |
| 4,734,061 | 3/1988 | Randall et al. | 439/709 |
| 4,735,586 | 4/1988 | Haller | 439/716 |
| 4,830,627 | 5/1989 | Heng et al. | 439/813 |
| 4,832,628 | 5/1989 | Huska | 439/716 |
| 4,911,655 | 3/1990 | Pinyan et al. | 439/412 |
| 4,983,133 | 1/1991 | Van Scyoc et al. | 439/860 |
| 5,171,160 | 12/1992 | Beins et al. | 439/329 |
| 5,249,989 | 10/1993 | Alsch | 439/813 |

FOREIGN PATENT DOCUMENTS

| | | | |
|---|---|---|---|
| 0535507 | 4/1993 | European Pat. Off. . | |
| 1112891 | 3/1956 | France . | |
| 2286519 | 4/1976 | France | 439/814 |
| 831275 | 2/1952 | Germany . | |
| 141885 | 5/1980 | Germany | 439/801 |
| 8520968 | 2/1988 | Germany . | |

*Primary Examiner*—Stephen P. Garbe
*Attorney, Agent, or Firm*—Driscoll Niwa

[57] ABSTRACT

A connector assembly comprises a housing and a clamping screw for clamping connection of ring tongue terminals to terminals of the connector assembly. The clamping screw comprises a flanged portion for, on the one hand clamping down on the terminal, and on the other hand engage against a shoulder of the housing when in the raised, disconnected position to prevent removal of the clamping screw from the housing. A U-shaped metal plate inserted in a housing slot transverse to the clamping screw, provides a second thread means to enable raising the clamping screw away from the mating clamping nut to allow unobstructed insertion of the ring tongue terminal therebetween.

7 Claims, 2 Drawing Sheets

ELECTRICAL CONNECTOR/ASSEMBLY WITH SCREW CLAMP TERMINALS

BACKGROUND OF THE INVENTION

1. Field of the Invention

This invention relates to an electrical connector assembly for screw clamp connection to electrical terminals, the assembly in particular comprising screw clamps that need not be removed for connection to ring tongue terminals.

2. Description of the Prior Art

It is common to interconnect single conductors to terminals of connector assemblies, in particular connector assemblies mounted to a panel such as in the telecommunications industry, by means of screw clamping the conductor thereto. Screw clamping provides a robust and secure connection to conducting wires and in particular if the wire is terminated by a ring tongue terminal through which the screw clamp is inserted and screwed to a nut thereby clamping the ring tongue therebetween. One of the problems with such prior art connector assemblies, is that the screw is removed to allow placing the ring tongue on the nut. For a compact connector, or in other cramped conditions, the screw is often not only difficult to remove but can then be easily lost and is often difficult to re-thread with the nut. It would therefore be desirable to provide a connector assembly with screw clamps that do not need to be removed therefrom but at the same time allow simple and unobstructed positioning of the conductor between the screw clamp and nut for clamping therebetween.

SUMMARY OF THE INVENTION

It is therefore an object of this invention to provide a connector assembly for screw clamping conductors to terminals thereof, without the possibility of losing the clamping screws.

It is a further object of this invention to provide a connector assembly with a screw clamp terminal that allows simple and rapid connection to conductors, and in particular conductors such as ring tongue terminals.

It is a further object of this invention to provide a connector assembly with screw clamps for connection to conductors, that is cost-effective yet easy to connect, reliable, and without the need for removing the screw clamps therefrom when connecting.

The objects of this invention have been achieved by providing a connector assembly having screw clamp terminals comprising a male screw and a nut for clamping a conductor and a terminal of the connector assembly therebetween, wherein the male screw member comprises a first threaded section for engagement with a nut, and a second threaded section separated from the first by a flange of greater diameter, the second threaded section engaging with a female thread member of the connector assembly to enable distancing the first threaded section from the nut; the clamping screw received in a cavity of the connector assembly housing, the cavity comprising a shoulder therein for abutment of the flange thereagainst to prevent removal of the clamping screw from the connector assembly housing.

DETAILED DESCRIPTION OF THE PREFERRED EMBODIMENT

Figure 1:
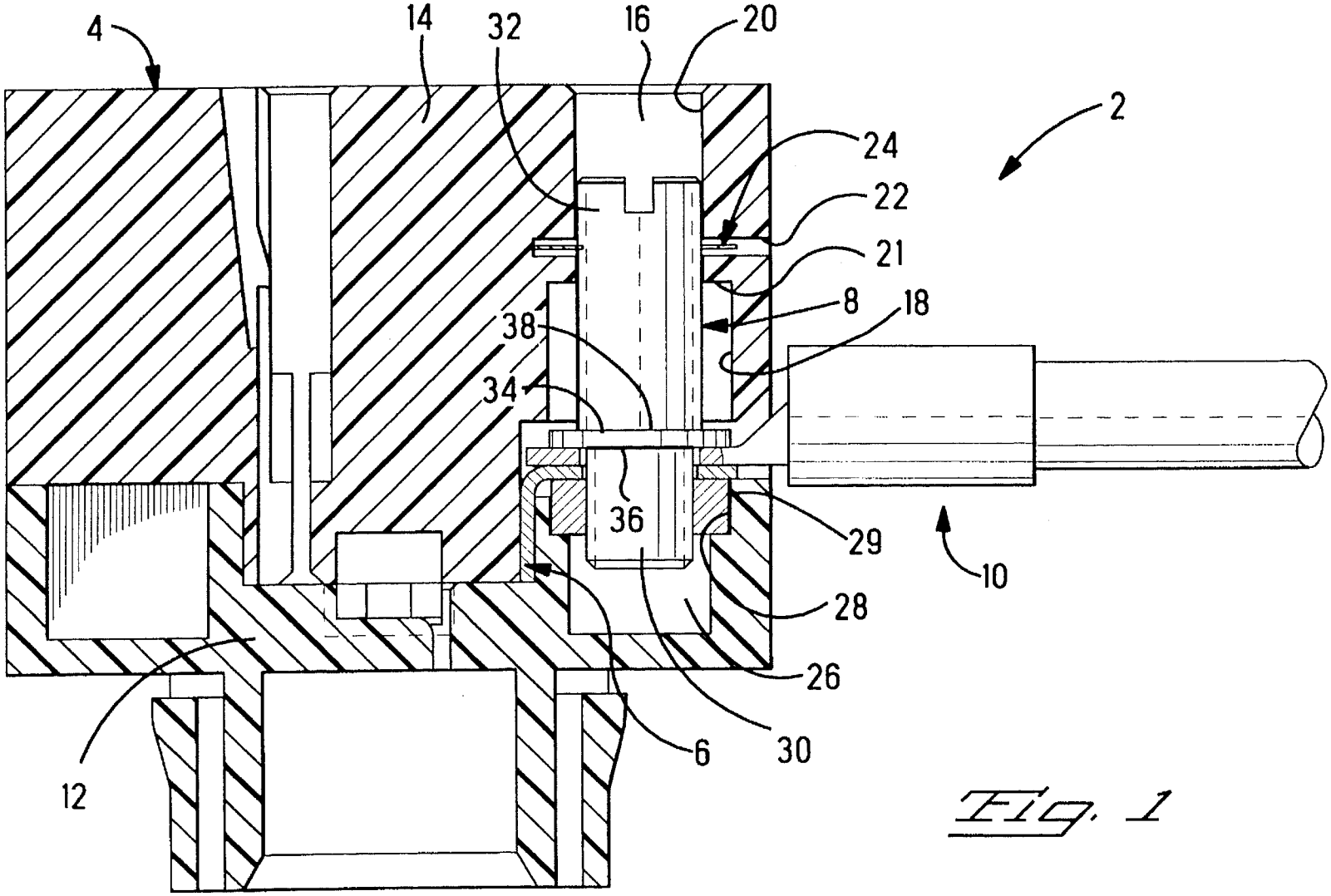
FIG. 1 is a cross-sectional view through a connector assembly fully terminated to a ring tongue terminal.

Referring first to FIG. 1, a connector assembly 2 comprises an insulative housing 4, terminals 6 mounted therein, and clamping screws 8 for clamping conductors 10 to the terminals 6 for electrical connection thereto. The housing 4 comprises a first housing section 12 for mounting to a panel (not shown) and a separate second housing section 14 assembled against the first housing section.

Figure 3:
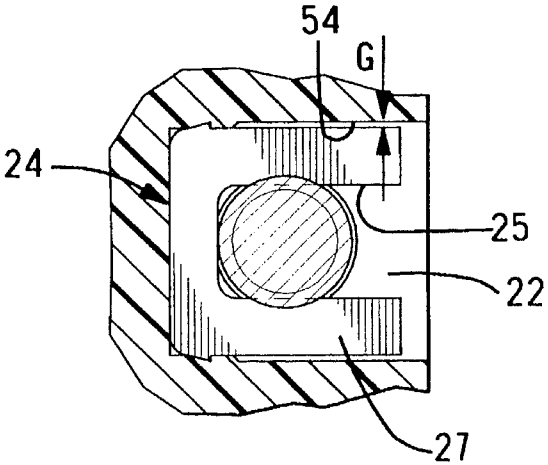
FIG. 3 is a partial cross-sectional view through lines 3—3 of FIG. 1.

The second housing section 14 further comprises a screw clamp receiving cavity 16 having a first portion 18 and a second portion 20 of smaller diameter than the first thereby forming a retaining shoulder 21 therebetween. Intersecting the cavity second portion 20 is a slot 22 for receiving a U-shaped metallic plate 24 comprising resilient arms 27 having an inner edge 25 as best seen in FIG. 3.

The first housing section 12 also comprises a cavity 26 substantially in alignment with the cavity 16, and has a nut receiving recess 28 at an upper end thereof.

The clamping screw 8 comprises a first threaded section 30, a second threaded section 32, and a flange 34 therebetween, the flange being of greater diameter than the threaded sections 30, 32 thereby forming a clamping surface 36 on one side and a retention surface 38 on the other side thereof.

Figure 2:
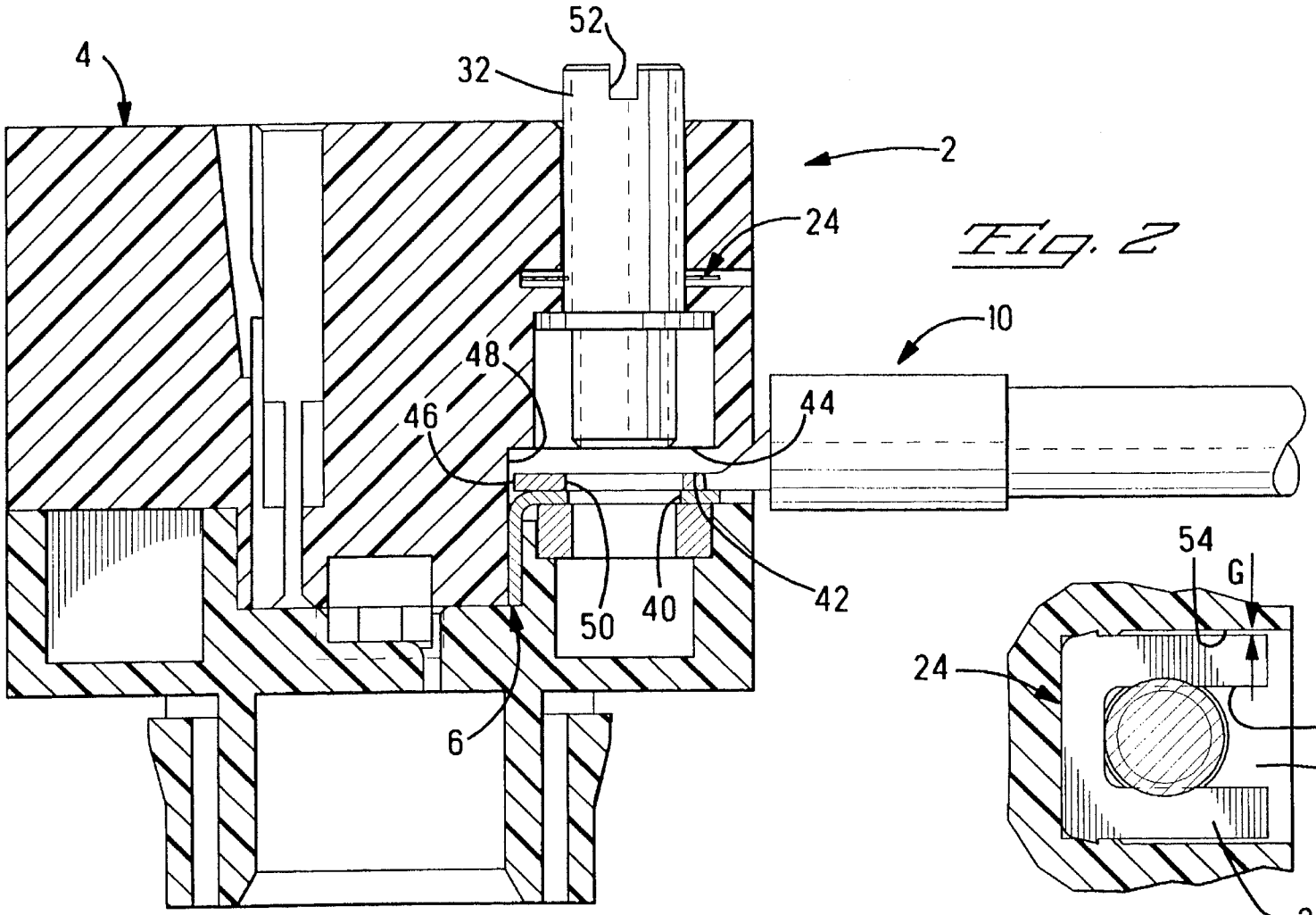
FIG. 2 is a similar cross-sectional view as that of FIG. 1 but showing a clamping screw in an open position for receiving or removal of a conductor.

The connector assembly 2 is assembled by first placing the nut 29 in the recess 28, positioning the terminal 6 in the first housing section; independently inserting the U-shaped metal plate 24 in the second housing section slot 22 and inserting the clamping screw 8 through the first cavity section 18; and finally threadably engaging the second threaded section 32 with the U-shaped inner edge 25 of the metal plate 24 until the flange 34 abuts the shoulder 21 as shown in FIG. 2. Alternatively, one could insert the second portion 32 of the clamping screw 8 into the cavity second section 20 and then insert the U-shaped metal plate 24 into the slot 22, in an orientation 180°from that shown in FIG. 3 such that the inner edge 25 slidably engages threaded grooves of the clamping screw when inserted therepast. The second housing section 14 can then be mounted to the first housing section 12 whereby the fixing of the housing sections 12 and 14 together holds the terminal 6 therebetween. The terminal 6 retains the nut in the nut receiving recess 28 such that no further retention means is needed therefor.

The terminal 6 comprises a hole 40 aligned with the hole of the nut 29 to allow passage of the male threaded section 30 therethrough. The other end of the terminal (not shown) comprises a connection section mounted within the insulative housing 4 for connection to terminals of a complementary connector (also not shown).

Connection of the terminal 10 to the terminal 6 is effectuated by inserting a ring tongue portion 42 of the terminal 10 into a terminal receiving slot 44 provided between the terminal 6 and second housing section 14, until a free end 46 of the ring tongue 42 abuts an end 48 of the slot 44. A hole 50 of the ring tongue terminal 42 is thereby aligned with the clamping screw for receiving the second threaded section 30 therethrough. The clamping screw can thus be rotated by inserting a screwdriver in a slot 52 at the free end of the first threaded section 32 whereby engagement of the clamping screw thread and U-shaped plate 24 causes the clamping screw 8 to be screwed downwards through the ring tongue and terminal holes 50, 40 until the second threaded section 30 engages with the nut 29. Continued rotation of the clamping screw 8 causes engagement of the threaded section 30 with the nut 29 until the flange 34 tightly clamps the ring tongue 42 and terminal 6 against the nut 29.

In order to compensate for slight mismatching of the threaded engagements between the plate 24 and first threaded section 32, and between the nut 29 and second threaded section 30, the slot 22 is provided with clearance allowing some movement thereof in the axial direction. Additionally, as seen in FIG. 3, a small gap (G) is provided between arms of the U-shape and sides 54 of the slot 22 to allow resilient spreading apart of the U-shaped cutout 25 enabling jumping of the plate 24 from one thread to the next if overstressed. The latter is also important when disconnecting the clamping screw 8 such that when the flange 34 abuts the housing shoulder 21, excessive torque damaging the screw or the housing will be avoided.

Provision of the clamping screw 8 with a retention flange 34 and second threaded section 32 engaging with the U-shaped plate 24, enables easy connection of a terminal 10 to the connector assembly whilst avoiding removal of the clamping screw 8 and additionally providing an unobstructed terminal receiving slot 44. The resiliency of the U-shaped plate 24, and the play provided in it's receiving slot 22 allows jumping of the thread to prevent over-torquing of the screw or compensate for thread mismatching. A further advantage is the secure retention of the nut 29 to the housing 4 by merely holding the connector assembly terminal 6 thereagainst. Provision of the connector housing 4 in two separate sections 12, 14 enables simple and rapid assembly of the various connector assembly components.

We claim:

1. An electrical connector assembly comprises a housing, a terminal, and a clamping screw for interconnecting a conductor to the terminal, the clamping screw comprising a first threaded section engageable with a complementary thread member for clamping the conductor therebetween, the assembly characterized in that the housing has a cavity for receiving the clamping screw, the cavity having a retention shoulder therein engageable against a retention surface of the clamping screw for preventing removal of the clamping screw from the connector assembly; the clamping screw further comprising a second threaded section engageable with a second complementary thread member in the housing, for displacing the clamping screw at a distance from the first complementary thread member and that the clamping screw comprises a flange positioned between the first and second threaded sections and of greater diameter than the threaded sections, the flange comprising the retention surface on one side thereof and a clamping surface on another side thereof, the clamping surface for clamping engagement against the conductor.

2. The assembly of claim 1 characterized in that the complementary threaded member comprises a thin resilient plate member having opposed edges engaging in a thread groove of the second threaded section.

3. The assembly of claim 2 characterized in that the plate member is U-shaped and has resilient arms for allowing jumping of the second threaded section during over-torquing of the clamping screw.

4. The assembly of claim 3 characterized in that the housing comprises a slot intersecting the screw receiving cavity, the slot for receiving the resilient plate member securely therein.

5. The assembly of claim 4 characterized in that the slot comprises side walls spaced apart from the resilient arms by a small gap (G) to allow outward resilient biasing of the arms during over-torquing of the clamping screw.

6. The assembly of any preceding claim characterized in that the housing comprises a first housing section and a separate second housing section, the second housing section having the screw clamp receiving cavity therein, and the second housing section having a recess for receiving the second complementary thread member therein, a slot being provided between the first and second housing sections for guiding the conductor between the clamping screw and second complementary thread member for clamping connection therebetween.

7. The assembly of claim 6 characterized in that the terminal is positioned over and against the second complementary thread member for retention thereof in the recess.

* * * * *